US007823841B2

(12) United States Patent
Anderson et al.

(10) Patent No.: US 7,823,841 B2
(45) Date of Patent: Nov. 2, 2010

(54) SYSTEM AND METHOD FOR BROKEN RAIL AND TRAIN DETECTION

(75) Inventors: Todd Alan Anderson, Niskayuna, NY (US); Emad Andarawis Andarawis, Ballston Lake, NY (US); Jeffrey Michael Fries, Lee's Summit, MO (US)

(73) Assignee: General Electric Company, Niskayuna, NY (US)

( * ) Notice: Subject to any disclaimer, the term of this patent is extended or adjusted under 35 U.S.C. 154(b) by 659 days.

(21) Appl. No.: 11/809,750

(22) Filed: Jun. 1, 2007

(65) Prior Publication Data

US 2008/0296441 A1 Dec. 4, 2008

(51) Int. Cl.
*B61L 23/04* (2006.01)
*G01R 31/08* (2006.01)

(52) U.S. Cl. ..... 246/121; 324/522

(58) Field of Classification Search ..... 246/20, 246/120, 121, 122 R, 218; 324/522
See application file for complete search history.

(56) References Cited

U.S. PATENT DOCUMENTS

| | | | | |
|---|---|---|---|---|
| 4,022,408 A | | 5/1977 | Staples | 246/34 R |
| 4,622,522 A | | 11/1986 | Alt | 333/24 R |
| 4,728,063 A | | 3/1988 | Petit et al. | 246/34 R |
| 4,886,226 A | | 12/1989 | Frielinghaus | 246/121 |
| 5,743,495 A | * | 4/1998 | Welles et al. | 246/121 |
| 5,769,364 A | | 6/1998 | Cippolone | 246/34 B |
| 5,868,360 A | * | 2/1999 | Bader et al. | 246/202 |
| 6,102,340 A | | 8/2000 | Peek et al. | 246/121 |
| 6,655,639 B2 | * | 12/2003 | Grappone | 246/120 |
| 7,226,021 B1 | * | 6/2007 | Anderson et al. | 246/121 |
| 7,268,565 B2 | * | 9/2007 | Anderson | 324/713 |
| 2003/0038216 A1 | | 2/2003 | Holgate | 246/122 R |

* cited by examiner

*Primary Examiner*—S. Joseph Morano
*Assistant Examiner*—Robert J McCarry, Jr.
(74) *Attorney, Agent, or Firm*—Marie-Claire Maple

(57) ABSTRACT

A rail break or rail vehicle detection system which includes a voltage source, capable of voltage source compensation, is coupled to each of a plurality of zones within a block of rail track devoid of insulated joints. A plurality of current sensors are provided, each coupled to a respective voltage source and configured to measure current flowing through the sensor in response to changing voltage patterns. Each current sensor is further configured in one embodiment to determine and compare signatures based on current measurements to a predetermined decision surface to detect the presence of a rail vehicle or rail break on a predetermined block of track. The voltage source or current sensor can be adapted to control voltage levels and polarity of each voltage source. A method of communicating the presence or absence of a rail break or rail vehicle employs an in-rail TDMA communication scheme to synchronize, test and communicate directly between the sensors without use of external controllers.

19 Claims, 13 Drawing Sheets

PATTERN AT TIME t2

PATTERN AT TIME t3

$$\begin{array}{r} \\ \text{SENSOR 2} \\ \text{SENSOR 3} \\ \\ \\ \end{array} \begin{bmatrix} 1 & 0 & 0 & 0 & 0 \\ 0 & 1 & 0 & 0 & 0 \\ 0 & 0 & 1 & 0 & 0 \\ 0 & 0 & 0 & 1 & 0 \\ 0 & 0 & 0 & 0 & 1 \end{bmatrix}$$

FIG.2

CURRENT AT TIME t2

CURRENT AT TIME t3

$$\begin{array}{r} \\ \text{SENSOR 2} \\ \text{SENSOR 3} \\ \\ \\ \end{array} \begin{bmatrix} m_{11} & m_{12} & m_{13} & m_{14} & m_{15} \\ m_{21} & m_{22} & m_{23} & m_{24} & m_{25} \\ m_{31} & m_{32} & m_{33} & m_{34} & m_{35} \\ m_{41} & m_{42} & m_{43} & m_{44} & m_{45} \\ m_{51} & m_{52} & m_{53} & m_{54} & m_{55} \end{bmatrix}$$

FIG.3

| FIG. 11A | FIG. 11B |
|---|---|

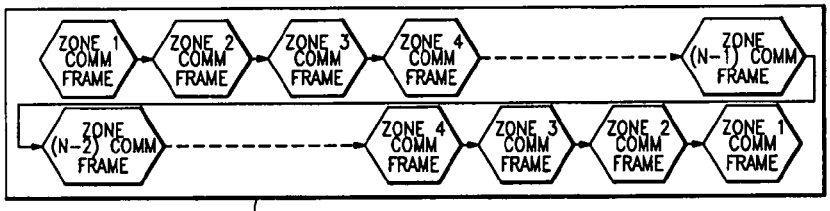
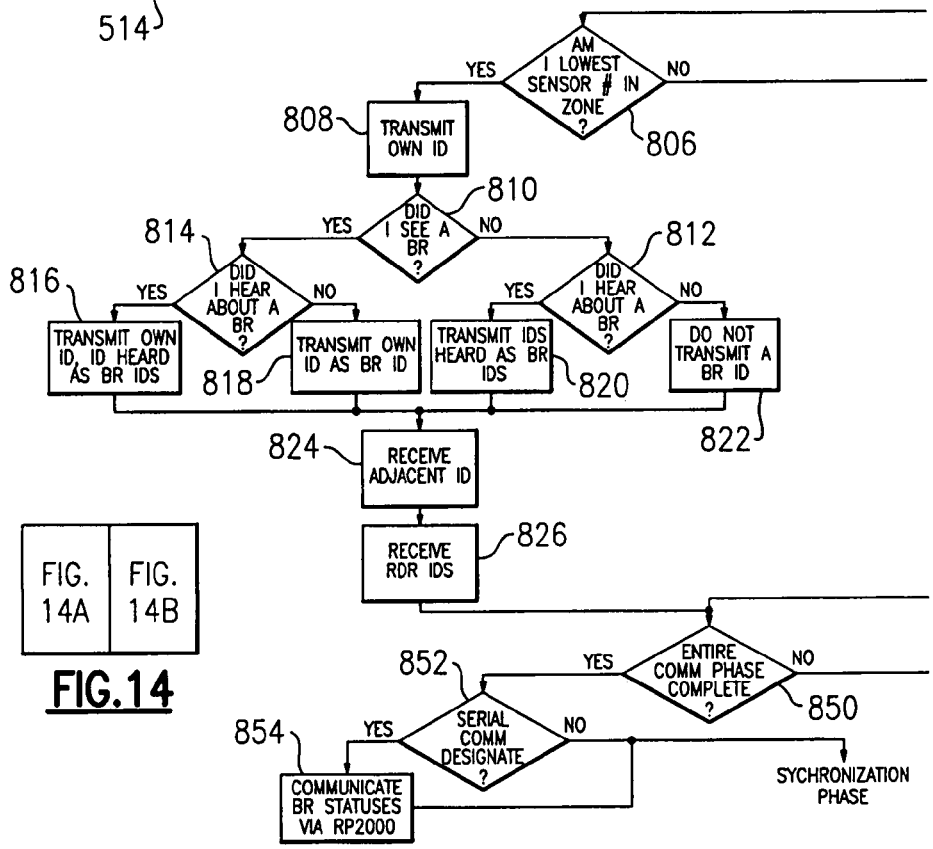
| FIG. 14A | FIG. 14B |
|---|---|
FIG.14
FIG.14A

SYSTEM AND METHOD FOR BROKEN RAIL AND TRAIN DETECTION

BACKGROUND

The present invention relates generally to a rail break or vehicle detection system and, more specifically, to a long-block multi-zone rail break or vehicle detection system, and a method for detecting a rail break and/or vehicle using such a system.

A conventional railway system employs a rail track as a part of a signal transmission path to detect existence of either a train or a rail break in a block section. In such a method, the track is electrically divided into a plurality of sections, each having a predetermined length. Each section forms a part of an electric circuit, and is referred to as a track circuit. A transmitter device and a receiver device are arranged respectively at either ends of the track circuit. The transmitter device transmits a signal for detecting a train or rail break continuously or at variable intervals and the receiver device receives the transmitted signal.

If a train or rail break is not present in the section formed by the track circuit, the receiver receives the signal transmitted by the transmitter. If a train or rail break is present, the receiver receives a modified signal transmitted by the transmitter, because of the change in the electrical circuit formed by the track and break, or track and train. In general, train presence modifies the track circuit through the addition of a shunt resistance from rail to rail. Break presence modifies the circuit through the addition of an increased resistance in the rail. Break or train detection is generally accomplished through a comparison of the signal received with a threshold value.

Conventional track circuits are generally applied to blocks of about 2.5 miles in length for detecting a train. In such a block, a train should exhibit a train shunt resistance of 0.06 ohms or less, and the ballast resistance or the resistance between the independent rails will generally be greater than 3 ohms/1000 feet. As the block length becomes longer, the overall resistance of a track circuit decreases due to the parallel addition of ballast resistance between the rails. Through this addition of parallel current paths, additional current flows through the ballast and ties and proportionally less through the receiver. Thus, the signal to noise ratio of the track circuits degrades with longer block lengths.

In one example, fiber optic-based track circuits may be employed for longer blocks (for example, greater than 3 miles) for detecting trains and rail breaks. However, cost for implementing the fiber optic based track circuit is relatively higher and durability may be lower. In yet another example, ballast resistance is increased and block length of the track circuit may be increased accordingly. However, maintenance cost for maintaining a relatively high ballast resistance is undesirably high.

An enhanced long block rail break or vehicle detection system and method is desirable. It would be beneficial and advantageous if the enhanced long block rail break or vehicle detection system and method compensated for variations in source and track wire resistance while simultaneously improving functional reliability to decrease false positive signals that indicate the presence of a break or train that does not exist and false negative signals that fail to indicate the presence of a break or train that does in fact exist.

BRIEF DESCRIPTION

In accordance with one embodiment of the present invention, a method for detecting a rail break or presence of a rail vehicle in a block of a rail track comprises: applying a plurality of voltage patterns across a block of track having a plurality of zones via a plurality of voltage sources; determining a plurality of signatures based on the plurality of voltage patterns; and comparing the plurality of signatures with a predetermined criteria to detect the presence of a rail break or rail vehicle in the block of rail track.

In accordance with another embodiment of the present invention, a system for detecting a rail break or presence of a rail vehicle in a block of a rail track in which the block of the rail track comprises a plurality of zones, comprises: a plurality of voltage sources, each coupled to one of the plurality of zones; and a plurality of current sensors, each coupled to a respective voltage source and configured to sense current flowing through the current sensor in response to changing voltage patterns generated by the plurality of voltage sources, and further configured to generate and compare a plurality of signatures based on the sensed current to a predetermined criteria to detect the presence of a rail break or rail vehicle in the block of rail track.

In accordance with yet another embodiment, a method of in-rail communication in a block of rail track devoid of insulated joints comprises: transmitting and receiving via a rail track, communication frames in a synchronized format between a plurality of sensors that are responsive to voltage pattern changes along desired portions of the block of rail track; and monitoring the communication frames to determine the presence of a rail break or rail vehicle in the block of rail track.

In accordance with still another embodiment of the present invention, a method for communicating the presence of a rail break or a rail vehicle in a block of a rail track having a plurality of zones comprises: in a block of rail track devoid of insulated joints, synchronizing via a communication scheme, communication between a plurality of sensors disposed along the block of rail track; applying a plurality of voltage patterns across the block of track having a plurality of zones via a plurality of voltage sources; monitoring a change in the plurality of voltage patterns via the plurality of sensors to detect the presence of a rail break or rail vehicle in one or more zones of the block of rail track; and communicating in a time division multiplexed access (TDMA) format between the plurality of sensors, sensor IDs that indicate the presence or absence of a rail break or rail vehicle within one or more zones of the block of rail track.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein:

FIG. 2 is a table representing sequential switching of the voltage sources positioned at intervals along a block section of a rail break or vehicle detection system in which "0"

Figure 1:
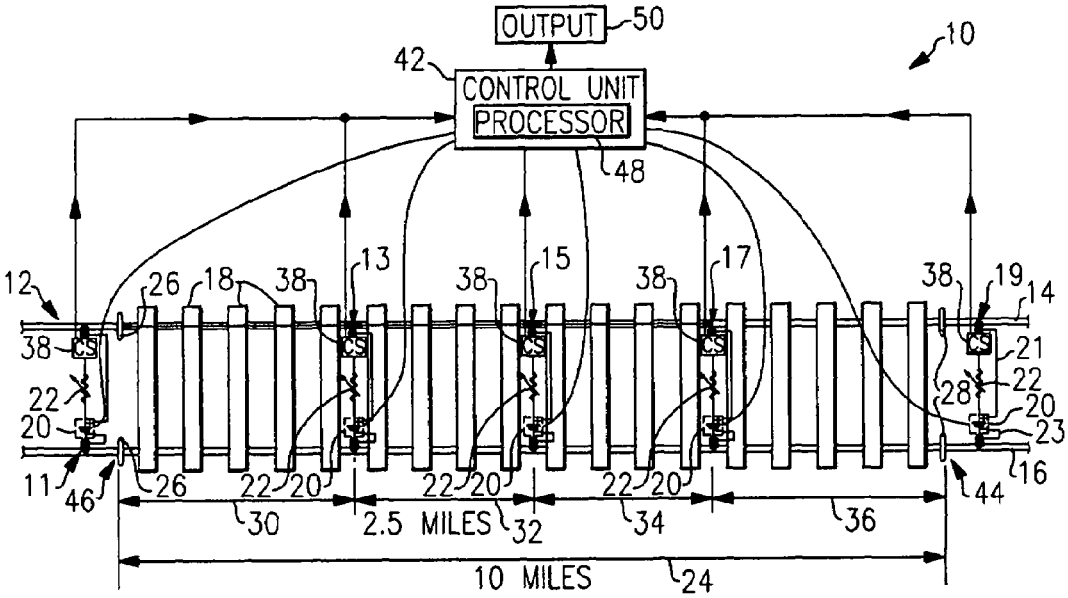
FIG. 1 is a block diagram of a rail break or vehicle detection system in accordance with one embodiment of the present invention.
Figure 4:
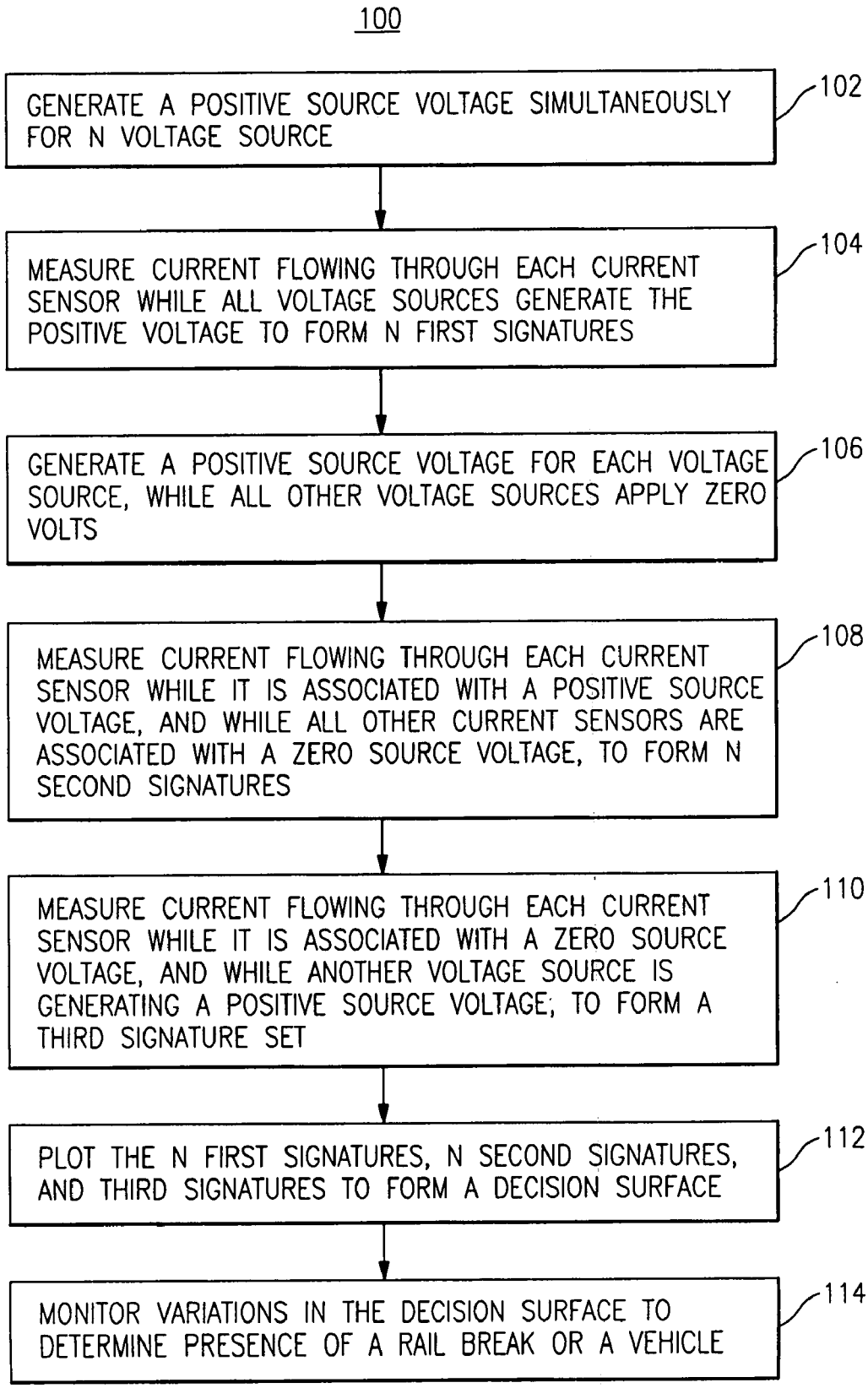
Figure 5:
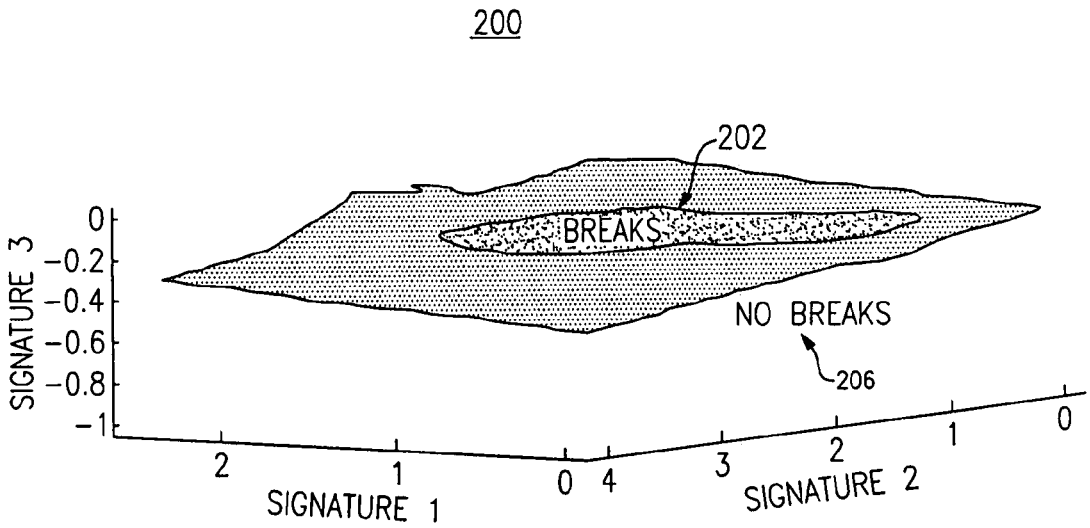
Figure 6:
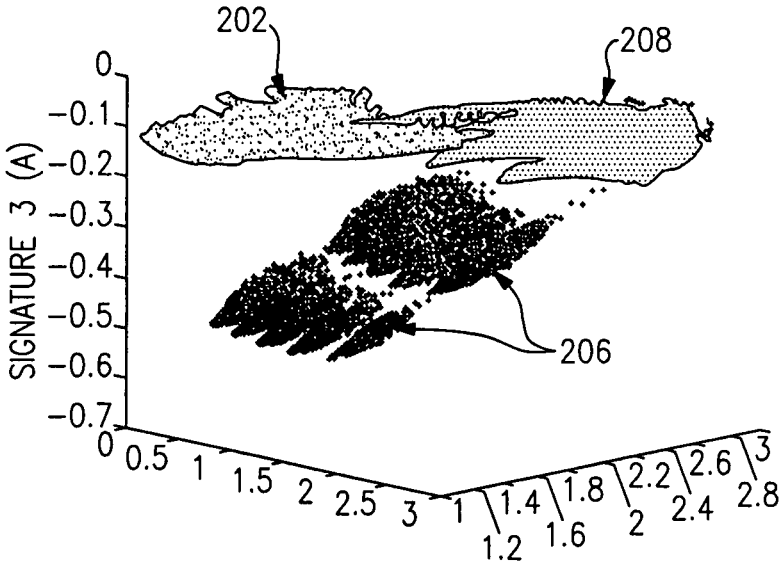
Figure 7:
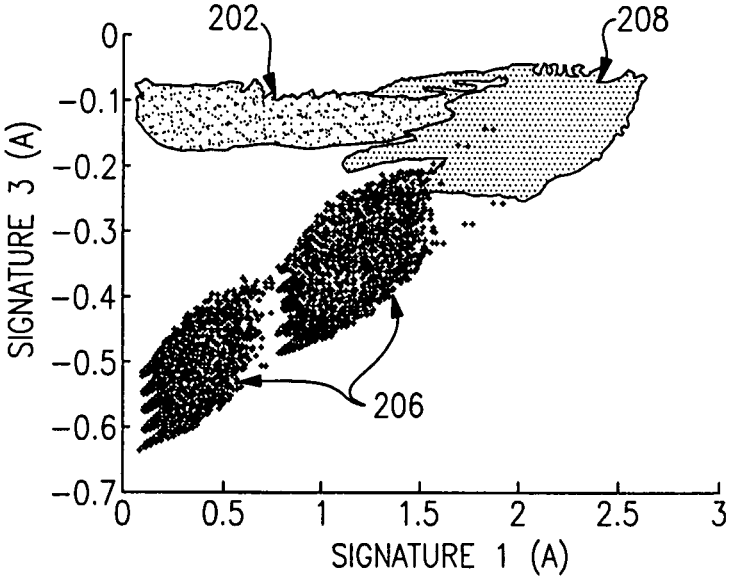
Figure 8:
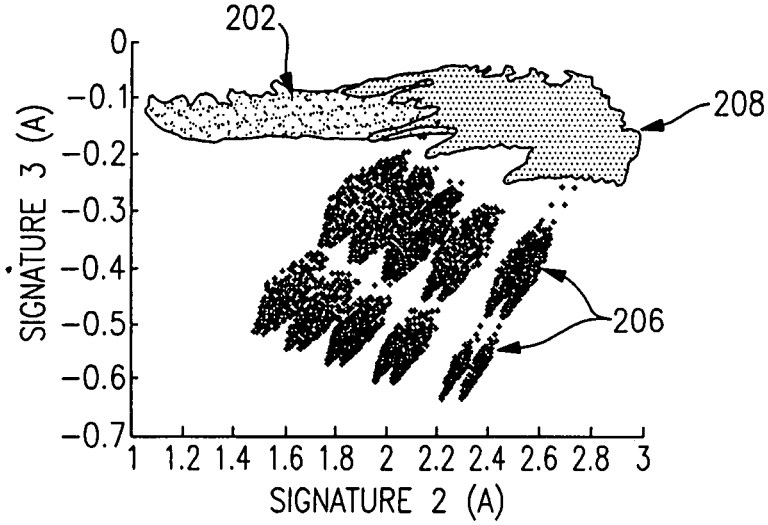
Figure 9:
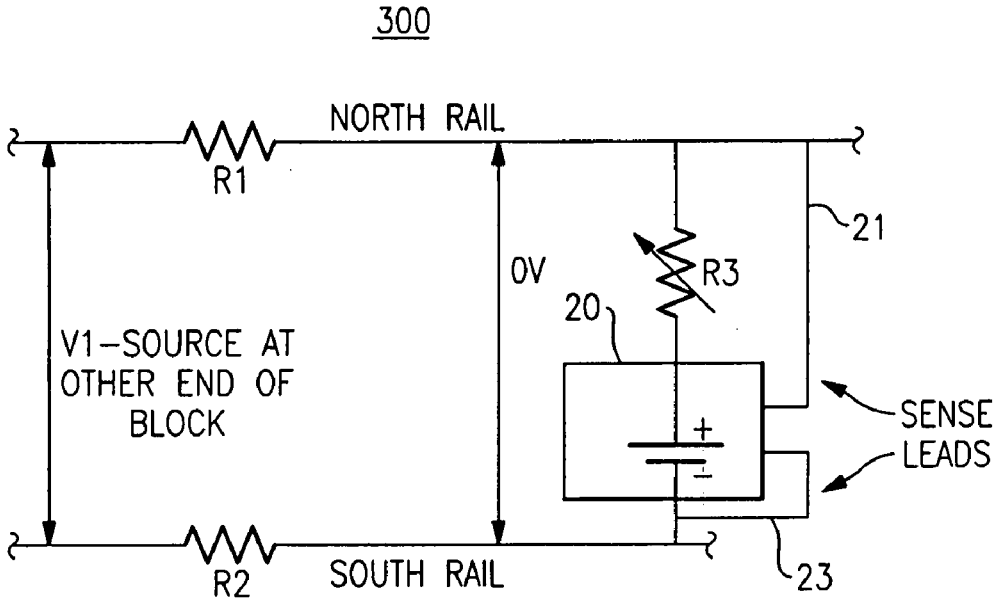
Figure 10:
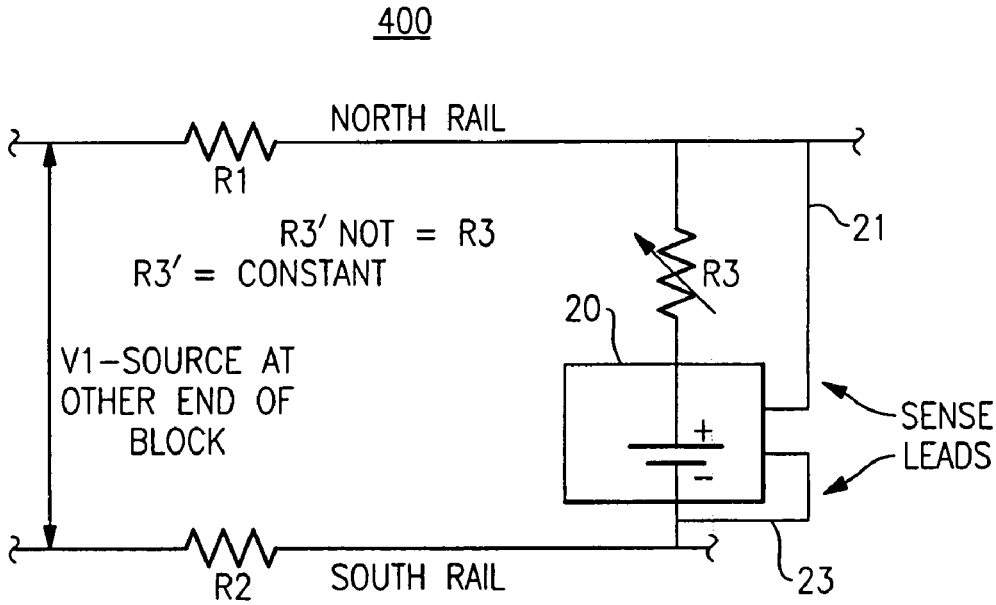
Figures 11, 11A:
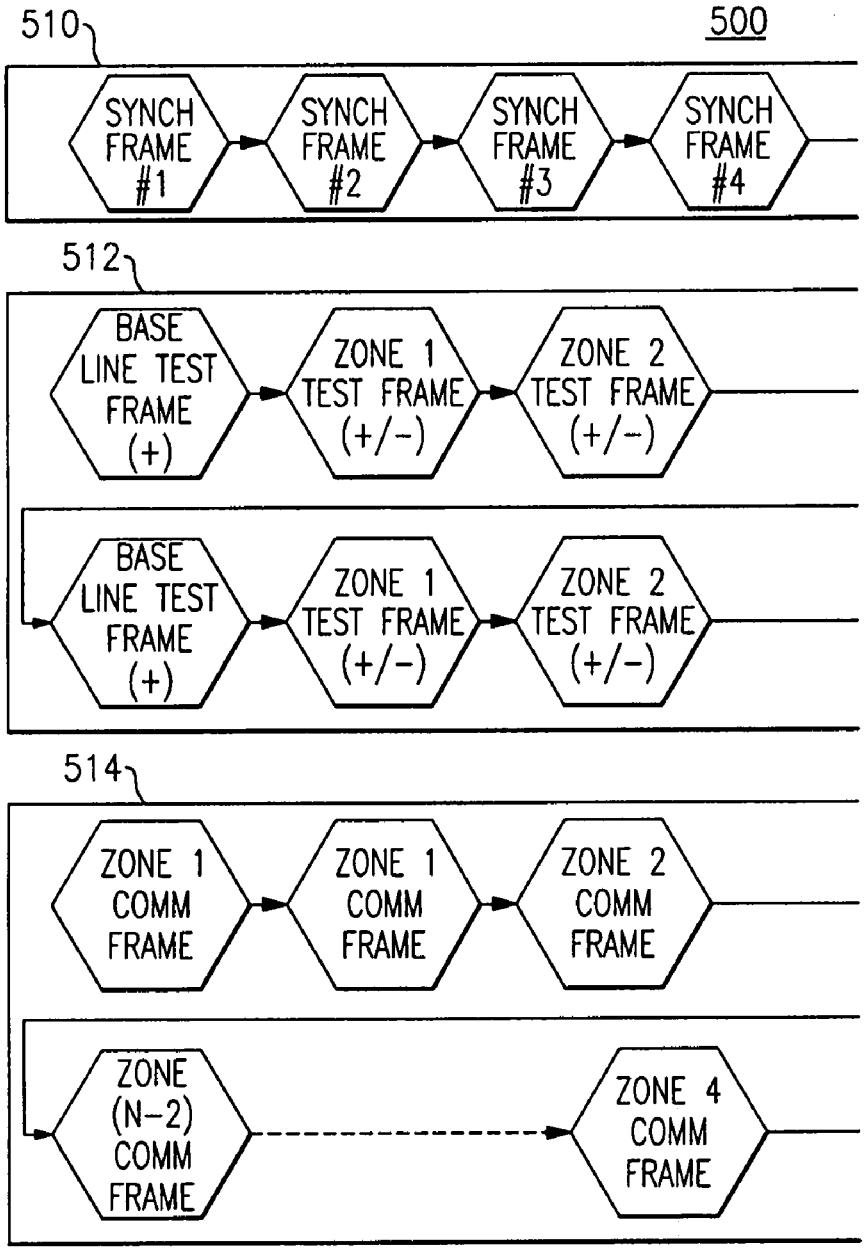
Figure 11B:
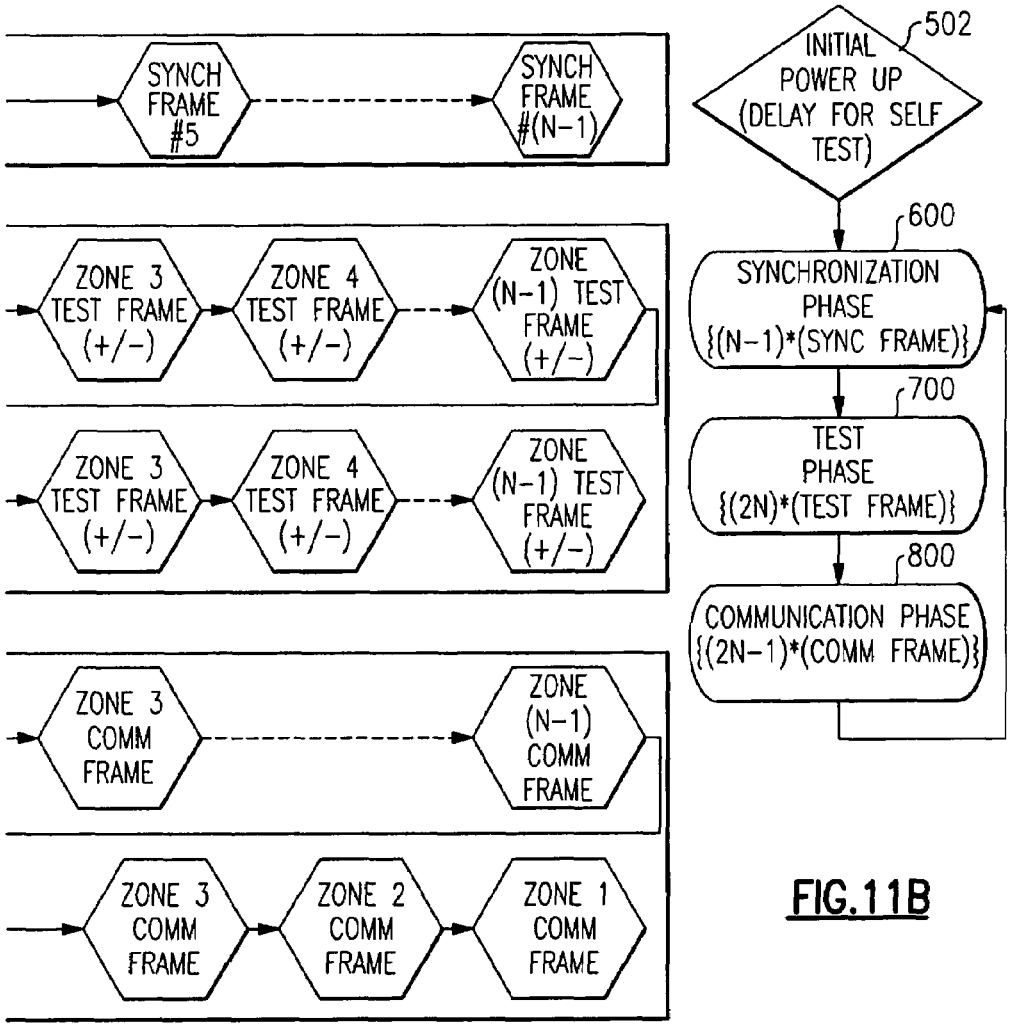
Figure 12:
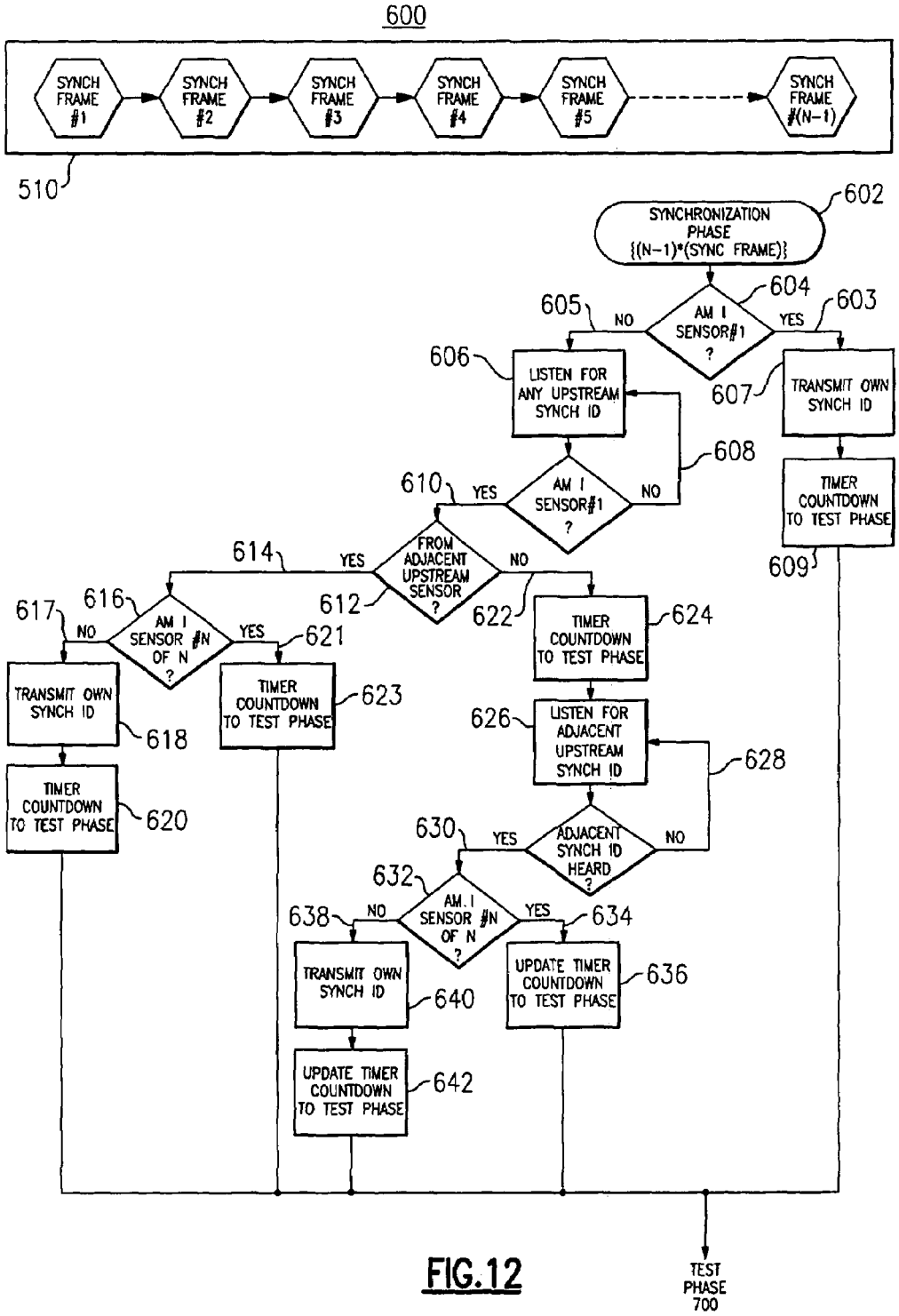
Figure 13:
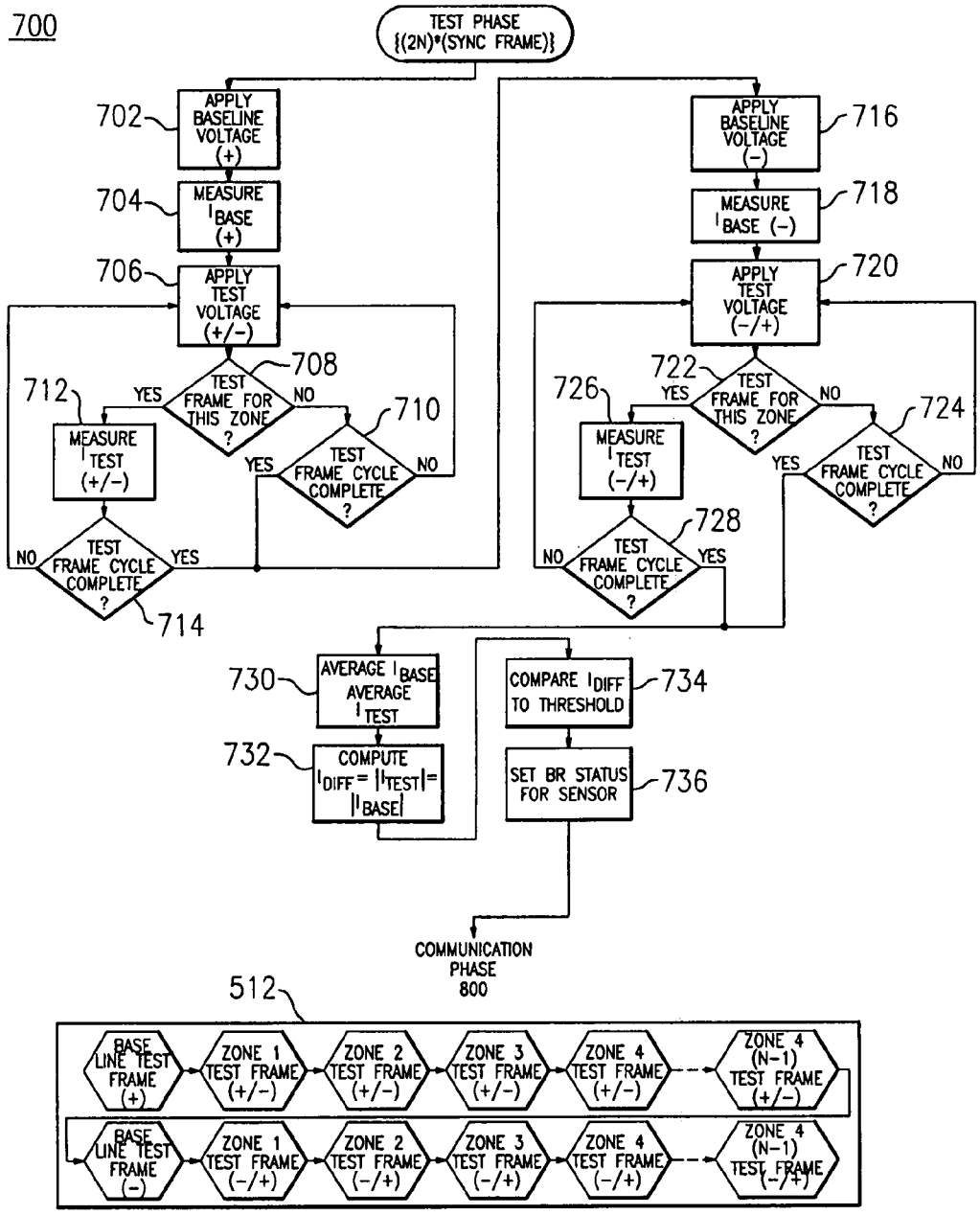
Figure 14B:
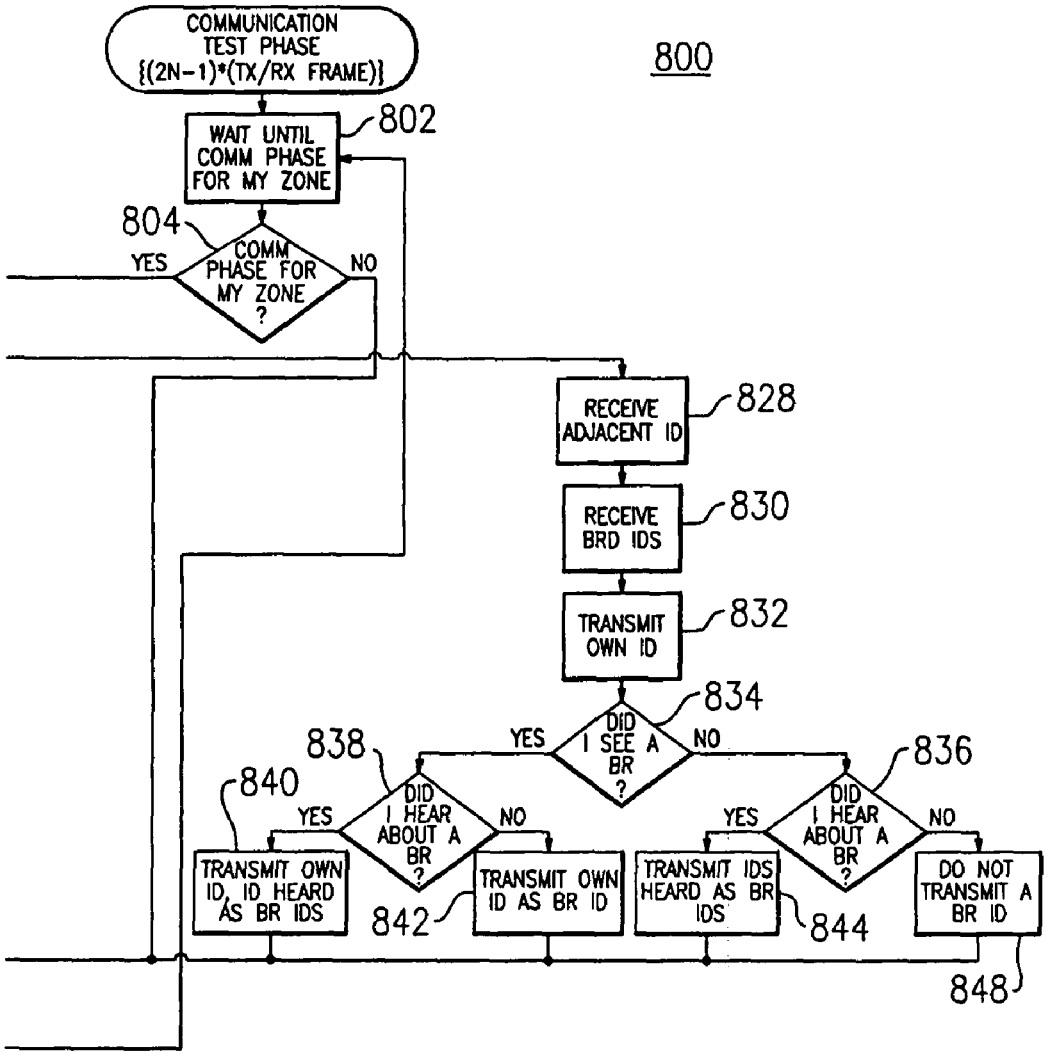
Figure 15:
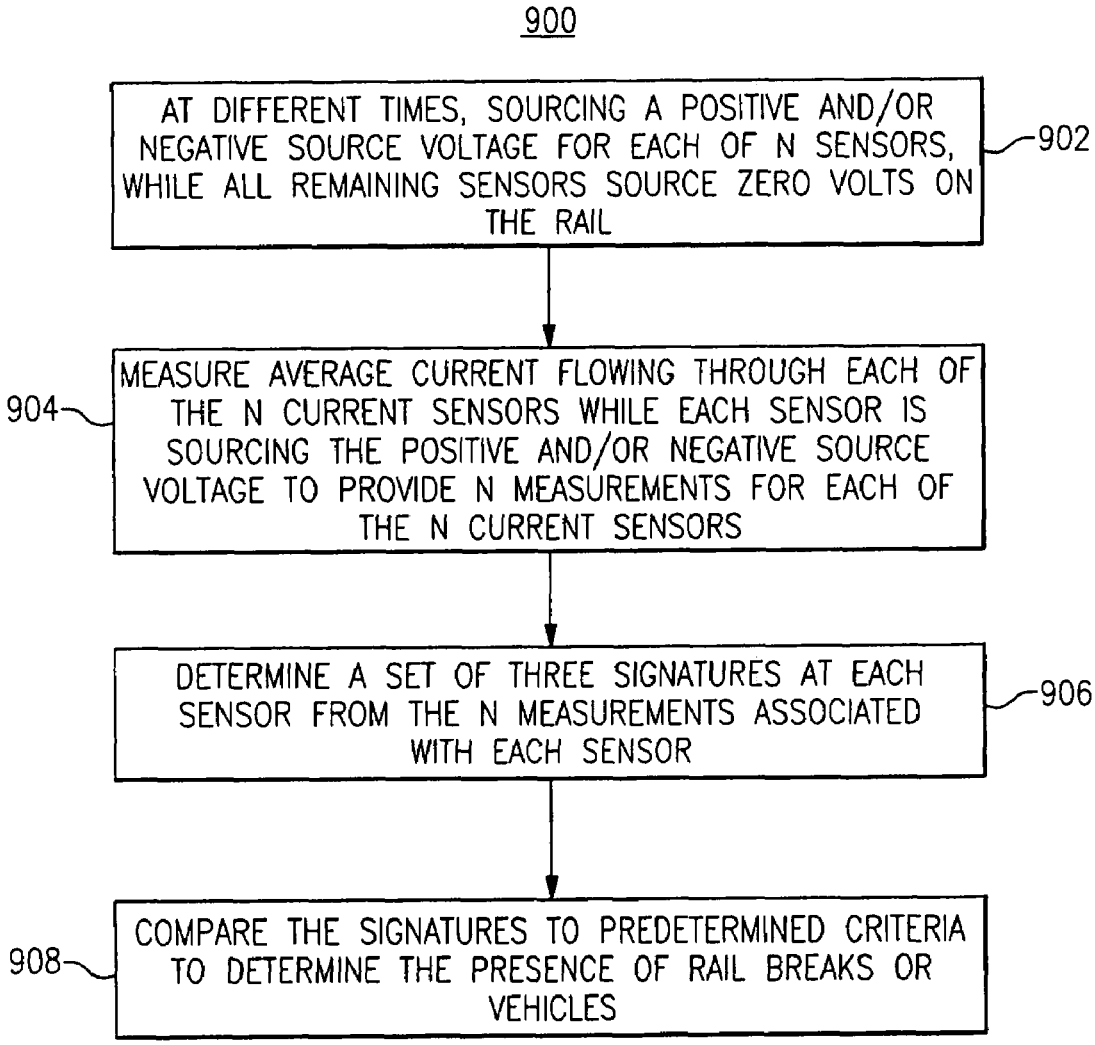

indicates transmitter off, and "1" indicates transmitter on, in accordance with aspects of FIG. 1;

FIG. 3 is a table illustrating currents sensed by the current sensors in response to sequential switching of the voltage sources positioned at intervals along a block section of a rail break or vehicle detection system in accordance with aspects of FIG. 1;

FIG. 4 is a flow chart illustrating a method of detecting rail break or vehicle presence in accordance with one embodiment of the present invention;

FIG. 5 is a pictorial diagram illustrating a decision surface for detecting a rail break in accordance with one embodiment of the present invention;

FIG. 6 is a pictorial diagram illustrating a three-dimensional decision surface for detecting a rail break and/or presence of a track vehicle such as a train, in accordance with one embodiment of the present invention;

FIG. 7 is a pictorial diagram illustrating a two-dimensional view of the decision surface depicted in FIG. 6;

FIG. 8 is a pictorial diagram illustrating another two-dimensional view of the decision surface depicted in FIG. 6;

FIG. 9 is a schematic diagram illustrating a source resistance compensation circuit suitable for implementing a voltage source illustrated in the rail break or vehicle detection system depicted in FIG. 1 in accordance with an exemplary embodiment of the present invention;

FIG. 10 is a schematic diagram illustrating another source resistance compensation circuit suitable for implementing a voltage source illustrated in the rail break or vehicle detection system depicted in FIG. 1 in accordance with an exemplary embodiment of the present invention;

FIG. 11 represents a flow diagram illustrating a method of synchronizing, testing and communicating between the current sensors depicted in FIG. 1 in accordance with an exemplary embodiment of the present invention, wherein FIG. 11 is illustrated in parts by FIG. 11A and FIG. 11B, such that FIGS. 11A and 11B are combined as illustrated by FIG. 11;

FIG. 12 is a detailed flow diagram of the synchronization phase depicted in FIG. 11 in accordance with an exemplary embodiment of the present invention;

FIG. 13 is a detailed flow diagram of the test phase depicted in FIG. 11 in accordance with an exemplary embodiment of the present invention;

FIG. 14 is represented in parts, by FIGS. 14A and 14B, which together illustrate a detailed flow diagram of the communication phase depicted in FIG. 11 in accordance with an exemplary embodiment of the present invention; and FIG. 15 is a flow chart illustrating a method of detecting rail break or vehicle presence in accordance with another embodiment of the present invention.

While the above-identified drawing figures set forth alternative embodiments, other embodiments of the present invention are also contemplated, as noted in the discussion. In all cases, this disclosure presents illustrated embodiments of the present invention by way of representation and not limitation. Numerous other modifications and embodiments can be devised by those skilled in the art which fall within the scope and spirit of the principles of this invention.

DETAILED DESCRIPTION

Referring generally to FIG. 1, in accordance with one embodiment of the present invention, a rail break or vehicle detection system is illustrated, and represented generally by the reference numeral 10. In the illustrated embodiment, the system 10 includes a railway track 12 having a left rail 14, a right rail 16, and a plurality of ties 18 extending between and generally transverse to the rails 14, 16. The ties 18 are coupled to the rails 14, 16 and provide lateral support to the rails 14, 16 configured to facilitate movement of vehicles, such a trains, trams, testing vehicles, or the like.

In the illustrated embodiment, a plurality (N) of voltage sources 20 with sense leads 21, 23 and voltage source resistance 22 provide 4-wire sensing to mitigate source resistance and create a desired source impedance at positions 11, 13, 15, 17, and 19 along a block section 24 formed between two pairs of insulated joints 26, 28 of the railway track 10. Source resistance 22 is not fixed, and varies with the type of voltage source 20, connections, track interface panels, and the like. Each voltage source 20 then includes a corresponding source resistance 22 and is provided between the rails 14, 16. Resultantly, the block section 24 is divided into a plurality of zones 30, 32, 34, and 36. In the illustrated example, the block section 24 of the railway track 12 has a length of about 10 miles. Each zone of the block section has a length of 2.5 miles. Those of ordinary skill in the art, however, will appreciate that the specific length of the block section 24 and the zones 30, 32, 34, and 36 are not an essential feature of the present invention. Similarly, the number of zones, resistors, and voltage sources are not an essential feature of the invention. Examples of voltage sources may include static or coded DC voltage source, static or coded AC voltage source, or the like. In the illustrated embodiment, the voltage sources 20 are configured to apply voltages across the block section 24 of the railway track 12. The summation of currents flowing through each source resistance 22 represents total ballast leakage current, when polarities of the voltage sources 20 are the same.

The system 10 further includes a plurality of current sensors 38, each current sensor 38 coupled in series with the corresponding voltage source 20. The current sensors 38 are configured to detect the current flowing through the current sensor in response to changing voltage patterns generated by the corresponding voltage source(s) 20. In another exemplary embodiment, the system 10 may include a plurality of voltage sensors, each voltage sensor coupled across the corresponding voltage source 20 and its respective source resistance 22. As known to those skilled in the art, current flowing through the source resistance 22 may be determined based on the detected voltage and the actual source resistance 22. A control unit 42 is in communication with the voltage sources 20, and the current sensors 38. In one embodiment, the control unit 42 is adapted to receive input from the current sensors 38 and monitor variation in current flow through each zone to detect a rail break or presence of a rail vehicle on the block section 24 of the railway track 12. In alternate exemplary embodiments, a plurality of control units may be used to receive inputs from the current sensors 38 and monitor variation in current flow through each zone to detect a rail break or presence of a rail vehicle on the block section 24 of the railway track 12.

One embodiment includes a control unit within each current sensor 38. Each current sensor 38 is configured to communicate directly with its adjacent current sensors 38 via these internal control units using the railway track 12 as a communication medium, as described in further detail herein below. An external control unit 42 is not required in this embodiment, since these internal control units are themselves configured to determine one or more signatures based on the sensed current flowing through the current sensors 38 in response to changing voltage patterns generated via the voltage sources 20. These signatures, in one embodiment, are compared with a predetermined decision surface to determine the presence of a rail break or rail vehicle within the block section 24

In one embodiment, the control unit 42 is configured to switch the plurality (N) of voltage sources 20 sequentially from a first end 44 towards a second end 46 of the block section 24. In another exemplary embodiment, the control unit 42 is configured to switch the plurality of voltage sources 20 sequentially from a second end 46 towards a first end 44 of the block section 24. In yet another exemplary embodiment, the control unit 42 is configured to switch the plurality of voltage sources 20 randomly or in any predefined order. This switching can also be controlled by the internal current source control units described above for one embodiment, that are configured to communicate in synchronization with one another, without need for the external control unit 42.

The plurality (N) of voltage sources 20 are switched during one time period, for example, such that all of the voltage sources 20 are set simultaneously to a desired positive voltage level. A first signature is determined for each current sensor 38 by measuring the current passing through the current sensor 38 when all voltage sources 20 are sourcing the desired positive voltage level. The plurality of voltage sources 20 can also be switched, for example, such that only one voltage source 20 is set to a desired voltage level while all remaining voltage sources 20 remain at zero volts during a desired time period. This process is repeated until each voltage source 20 applies a desired voltage level during a respective time period, while all other voltage sources 20 apply zero volts, resulting in N-measurements for N-voltage sources 20. A second signature associated with each current sensor 38 is formed from the N-measurements. The second signature, in one embodiment, is the current passing through a current sensor 38 in response to its respective voltage source 20 that is generating a positive voltage while all remaining voltage sources 20 are at zero volts. A third signature, in one embodiment, is the current passing through a current sensor 38 while its respective voltage source 20 is set to zero volts and while no more than one different voltage source 20 on either side of the current sensor 38 is simultaneously set to a desired voltage level. Those of ordinary skill in the art will readily appreciate that any number of signatures can be employed, depending only upon the desired type, level of accuracy and reliability of the measurements to be achieved. The desired voltage level can also be, for example, one volt or any combination of suitable voltage levels that can be scaled to form a relationship between the signatures.

When the block section 24 of the railway track 12 is unoccupied by the rail vehicle or a rail break is not detected, a specific current is detected in a particular zone having voltage sources 20 sequenced as described herein before, and located respectively at either ends of the zone. For example, if the zone 30 has voltage sources 20 at its ends at a particular instant during the voltage sequencing process, a specific current is detected in the zone 30, when the block section 24 of the railway track 12 is unoccupied by a rail vehicle or a rail break is not detected. When the block section 24 of the railway track 12 is occupied by wheels of a rail vehicle or a rail break is detected, a negligible change in current is detected in a particular zone having sequenced voltage sources 20 located respectively at either ends of the zone. For example, if the zone 30 has voltage sources 20 at its ends at a particular instant during the voltage sequencing process, a negligible change in current is detected in the zone 30, when the block section 24 of the railway track 12 is occupied by the rail vehicle or a rail break is detected.

In another exemplary embodiment, the control unit 42 is adapted to detect presence of a rail break or vehicle in the block section 24, when the change in current at a particular instant of a particular zone having sequenced voltage sources 20 located respectively at either ends of the zone, is greater than a predetermined threshold limit. The predetermined threshold limit can be dependent on, but not limited to, a variation in a ballast resistance value of the block. The control unit 42 or the current source controllers are configured to determine a plurality of signature values such as described herein before, for the block section 24 and then determine the presence of a break or vehicle based within the block section 24 by comparing the signature values with a predetermined decision surface. Optimization processes, neural networks, and classification algorithms, among other techniques, may be used to create the decision surface that can be used to differentiate between a rail break and the presence of a rail vehicle on the block section 24 of the railway track 12. Differentiation between a break in the track and the presence of a rail vehicle in accordance with aspects of the present invention is described in further detail below with reference to subsequent figures.

The control unit 42 or the current source controllers, in one embodiment, each includes a processor 48 having hardware circuitry and/or software that facilitates the processing of signals from the current sensors 38 and the voltage sources 20. As will be appreciated by those skilled in the art, the processor 48 may include, but is not limited to, a computer, microprocessor, a programmable logic controller, digital signal processor, a logic module, or the like. As discussed previously, in the illustrated embodiment, the control unit 42 or the current source controllers are adapted to sequentially switch the voltage sources 20 from the first end 44 towards the second end 46 of the block section 24 and vice versa (i.e. from the second end 46 to the first end 44) or randomly. The values and/or polarities of the voltage sources 20 may also be varied and/or switched respectively; and the measurements of the respective current sensors 38 may then be averaged to mitigate systematic and galvanic errors.

In certain embodiments, the control unit 42 or current source controllers may further include a database, and an algorithm implemented as a computer program executed by the control unit computer or the processor 48. The database may be configured to store predefined information about the rail break or vehicle detection system 10 and rail vehicles. The database may also include instruction sets, maps, lookup tables, variables or the like. Such maps, lookup tables, and instruction sets, are operative to correlate characteristics of current flowing through the plurality of zones to detect rail break or presence of a rail vehicle. The database may also be configured to store actual sensed or detected information pertaining to the current, voltage across the rails 14, 16, polarities of the voltage sources 20, ballast resistance values of the block section 24, predetermined threshold limit(s) for the change in current, rail vehicles, and so forth. The algorithm may facilitate the processing of sensed information pertaining to the current, voltage, and rail vehicle. Any of the above mentioned parameters may be selectively and/or dynamically adapted or altered relative to time. In one example, the control unit 42 or current source controllers are configured to update a predetermined threshold limit based on a ballast resistance value of the block section 24, since the ballast resistance value varies due to changes in environmental conditions, such as humidity, precipitations, or the like. The processor 48 transmits indication signals to an output unit 50 via a wired connection port or a short range wireless link such as infrared protocol, bluetooth protocol, I.E.E.E 802.11 wireless local area network or the like. In general, the indication signal may provide a simple status output, or may be used to activate or set a flag, such as an alert based on the detected current in the plurality of zones of the block section 24. The status output can be a discrete output, an indication, or some type of communication message, or the like.

Referring now to FIG. 2, a table representing sequential switching of the voltage sources 20 located at positions 11, 13, 15, 17, and 19 of the plurality of zones 30, 32, 34, 36 are illustrated in accordance with aspects of FIG. 1. According to one embodiment, and prior to such sequential switching, the voltage sources 20 located at positions 11, 13, 15, 17 and 19 are all switched simultaneously to a positive voltage that can be any desired value common to all voltage sources 20. This "all on" step can just as well be replaced, for example, by a switching step in which each sensor is switched on and off in sequence with one another. The sum of the resultant measurements on a row in FIG. 2 can then be used to determine the first signature. Subsequently, the voltage sources 20 located at positions 19, 17, 15, 13, and 11 are switched (i.e. between zero volts and a positive voltage value) sequentially from the first end 44 to the second end 46 as represented by numerals 0 and 1 in FIG. 2. A negative voltage value can also be employed, alone or in combination with a positive voltage. An average value can then be obtained to compensate for noise. The above-mentioned order of switching is merely an example, and in other exemplary embodiments, the order of switching may vary in a predefined order depending on the requirement.

FIG. 3 is a table illustrating currents sensed by the current sensors 38 in response to sequential switching of the voltage sources 20 positioned at intervals along a block section 24 of a rail break or vehicle detection system in accordance with aspects of FIG. 1. In the illustrated embodiment, for example, the current sensors 38 during initial sequencing of voltage sources 20, each measures a first set of values (signatures) indicative of the current flowing through the respective source resistances 22. All the voltage sources, for one embodiment, have positive values during the initial sequencing, as stated herein before. Subsequently, the voltage sources 20 are sequentially switched such that each voltage source 20 is either switched to or remains at the positive voltage value while all other voltage sources 20 are simultaneously switched to zero volts. The current sensors 38 each measure a second set of values (signatures) indicative of current flowing through the respective voltage source resistance 22 while the respective voltage source 20 generates the positive voltage and during which time all other voltage sources 20 generate zero volts. At the above-mentioned second test, the zone 36 has voltage sources with a positive voltage and zero voltage respectively located at its either ends. A third set of values (signatures) measured by the current sensors 38 are indicative of current flowing through the respective source resistances 22, while the respective voltage sources 20 are set to zero volts and during which time, no more than one voltage source on either side of the respective voltage source 20 is set to generate the positive voltage. The control unit 42 in one embodiment or current source controllers that are internal to the current sources 38 in another embodiment each receives inputs from the plurality of current sensors 38, processes the currents to determine a desired number of signatures, and compares these signatures with a predetermined decision surface, such as discussed herein before, to detect train occupancy or presence of rail break in the block section 24. If a train occupancy or rail break does not exist, a specific current is detected in the zone 36. If a train occupancy or rail break exists, a corresponding break in the decision surface then denotes a negligible change in the current that is detected in the zone 36. In one embodiment, a change in current in the zone 36 that is greater than a predetermined threshold limit will appear to show the existence of train occupancy or a rail break. The above-mentioned process is repeated for each zone in the block section 24. Any desired number of signatures can be used to compare against the decision surface; and the number of signatures is not limited to that described in the embodiments.

The control unit 42 or current controllers may be configured to average different sets of values (signatures) for each zone in order to mitigate systematic and galvanic errors. In one example, the current values (signatures) of the sensors 38 having positive values during one time period are averaged with the absolute values of current values (signatures) of the same sensors 38 having negative values during a different time period, to mitigate systematic and galvanic errors. Similarly, any number of examples is envisaged.

In accordance with aspects of the present invention, the zone length of each zone of the block section is determined based on the resolution of the current sensors 38. As discussed previously, when the block section of the railway track 12 is occupied by wheels of a rail vehicle or a rail break is detected, a negligible increase in current is detected in a particular zone having voltage sources located respectively at either ends. The current sensor 38 in accordance with aspects of the present invention is capable of resolving changes in current measurements, when a rail break or train presence is detected in the block section. The greater the zone length, the smaller the changes become in the current measurements.

FIG. 4 is a flow chart 100 illustrating a method of detecting a rail break or vehicle presence in accordance with one embodiment of the present invention. According to one embodiment, the method includes applying a positive voltage across the block section 24 of the railway track 12 simultaneously via a plurality of voltage sources 20 as represented by step 102. Each source resistance 22 coupled in series with a corresponding voltage source 20, receives a current from the voltage applied by its corresponding voltage source 20. The current sensors 38 detect the current flowing through their corresponding voltage source resistance 22. Initially, the current sensors 38 measure a first set of values indicative of currents flowing through each source resistance as represented by step 104 while all voltage sources 20 simultaneously generate a positive voltage.

Each voltage source 20 is then controlled in sequence to generate a positive voltage while all other voltage sources apply zero volts, as represented by step 106. Again, the current sensors 38 detect the current flowing through their corresponding voltage source resistance 22. The current sensors 38 in this instance measure a second set of values indicative of current flowing through each source resistance 22 while a corresponding voltage source generates the positive voltage for the zone, and while all other voltage sources associated with the other zones apply zero source voltage, as represented by step 108.

A third set of values is also measured by the current sensors 38, as represented by step 110. This third set of values indicates the current flowing through each source resistance 22 while its corresponding voltage source is set to generate zero volts, during which time no more than one different voltage source 20 is generating the positive source voltage, to form the third set of current values.

Three signatures are then determined for each current sensor 38 based on the foregoing current measurements as represented in step 112. These signatures are compared in one embodiment, to a predetermined decision surface that is determined via an optimization algorithm, a neural network, or other appropriate scheme. Signature variations from the decision surface are monitored via control unit 42 or the internal current source controllers to determine the presence of a vehicle or the presence of a rail break, as represented by step 114.

Another embodiment showing a method 900 of detecting the presence of a rail break or vehicle is shown in FIG. 15. At different times, each sensor 38 within a plurality of N sensors, sources a positive and/or negative source voltage such as represented by step 902, while the remaining sensors source zero volts on the rail 14 shown in FIG. 1. An average of the absolute value of current flow is then measured for each sensor 38 to provide N measurements for each of the N current sensors 38 as represented in step 904. Three signatures at each sensor 38 are then determined from the N measurements associated with each sensor 38 as represented in step 906. Finally, the signatures are compared with predetermined criteria to determine the presence of rail breaks or vehicles, as represented in step 908.

The sets of first signatures, second signatures, and third signatures determined in step 906 can be compared, for example, with a predetermined decision surface that is determined via an optimization algorithm, a neural network, or other appropriate scheme. Signature variations from the decision surface are then monitored by the current sensor controllers or other desired monitoring unit(s) to determine the presence of a vehicle or the presence of a rail break.

FIG. 5 is a pictorial diagram illustrating a three-dimensional decision surface 200 for detecting a rail break in accordance with an exemplary embodiment of the present invention. As stated herein before, the control unit 42 or current sensor controllers each receives the current inputs from the plurality of current sensors 38 and compares the corresponding signatures with a predetermined decision surface represented by step 112 in FIG. 4. If a rail break does not exist, a specific current is detected in the zone represented by its measured signature values. If a rail break is seen to exist, a negligible change in current is detected in the respective zone via a change in signature values corresponding to the zone that now shows a break in the decision surface for that zone. In one embodiment, if the change in current in the zone is greater than a predetermined threshold limit, existence of a rail break is detected. Such rail break then appears as a break area 202 in the surface pattern of the decision surface 200. An area of the decision surface 200 that is further away from the break area 202 is defined as a no break area 206.

FIG. 6 is a pictorial diagram illustrating another three-dimensional decision surface for detecting a rail break and/or presence of a track vehicle such as a train, in accordance with an exemplary embodiment of the present invention. The control unit 42 or current sensor controller(s) receives the measured current inputs from the plurality of current sensors 38 and compares the corresponding signatures with a predetermined decision surface represented by step 112 in FIG. 4. If a rail break or rail vehicle does not exist, a specific current is detected in the zone represented by its measured signature values. If a rail break or rail vehicle is seen to exist, a negligible change in current is detected in the respective zone via a change in signature values corresponding to the zone that now shows a break or presence of a rail vehicle in the decision surface for that zone. In one embodiment, if the change in current in the zone is greater than a first predetermined threshold limit, existence of a rail break is detected; while if the change in current in the zone is greater than a second predetermined threshold limit, presence of a vehicle is detected. Such rail break then appears as a break area 202 in the surface pattern of the decision surface, while presence of a rail vehicle appears as an area 208 having higher signature values in two of the three dimensions. An area 206 of the decision surface that is removed from the break area 202 and the vehicle presence area 208 appears as an area having a lower signature value in one of the three dimensions.

FIG. 7 is a pictorial diagram illustrating a two-dimensional view of the decision surface depicted in FIG. 6, showing that rail vehicle presence area 206 has a lower signature value in one of the three dimensions (i.e. signature 3 dimension).

FIG. 8 is a pictorial diagram illustrating another two-dimensional view of the decision surface depicted in FIG. 6, showing that rail vehicle presence area 206 has a lower signature value in one of the three dimensions (i.e. signature 3 dimension).

FIG. 9 is a schematic diagram illustrating a source resistance compensation circuit 300 suitable for implementing the voltage source circuit illustrated in the rail break or vehicle detection system depicted in FIG. 1 in accordance with an exemplary embodiment of the present invention. Source resistance compensation circuit 300 includes a source wire resistance R3 that was found by the present inventors to have an undesirable impact on the variation of the distributions of surface areas 202, 206 and 208. The source wire resistance R3 was found to contribute, for example, to a distribution surface 200 that produces an undesirably high number of false positive and false negative readings. The source compensation circuit 300 is implemented using a four-wire architecture that includes sense leads 21, 23, allowing the source voltage 20 to be adjusted until zero volts appears across the rails 14, 16, depicted in FIG. 1, thus making source wire resistance R3 appear as a zero-Ohm source impedance.

FIG. 10 is a schematic diagram illustrating another source resistance compensation circuit 400 suitable for implementing the voltage source illustrated in the rail break or vehicle detection system depicted in FIG. 1 in accordance with an exemplary embodiment of the present invention. Source resistance compensation circuit 400 also includes a source wire resistance R3 that contributes to formation of a distribution surface 200 that produces an undesirably high number of false positive and false negative readings. The source compensation circuit 400 is also implemented using a four-wire architecture that includes sense leads 21, 23, allowing the source voltage 20 to be adjusted until zero volts appears across the rails 14, 16, depicted in FIG. 1. Source compensation circuit 400 is different from source compensation circuit 300 however, in that the source voltage in source compensation circuit 400 is adjusted such that the source wire resistance R3 will be transformed to appear as a positive source wire impedance R3' instead of a zero source wire impedance R3. Source resistance compensation circuit 400 is useful to prevent saturation of the voltage source/current source associated with the source resistance compensation circuit 400 when a train is sitting on the rails, since a train that is sitting on the rails when using source resistance compensation circuit 300 can cause the voltage source/current source to quickly reach its maximum power limits.

Keeping the foregoing principles in mind, a method of detecting the presence of a broken rail or a rail vehicle in or more particular zones without the necessity for insulated joints in a desired section of track rails is described below with reference to FIGS. 11-14. The method is directed to in-rail communication that provides a lower cost solution than known methods since it avoids the use of a control unit 42, allowing each of the sensors to communicate with one another using the rail, and cascade information to a central collecting point. Since the section of track rails does not include insulated joints, the section is electrically continuous. Therefore, in order to maximize the distance between sensors 38, the lowest frequency should be used for rail communication (i.e. DC or 0 Hz). If all sensors 38 operate at the same frequency, they cannot all communicate at the same time. The present inventors recognized an arbitration (synchronization) scheme using TDMA principles that could be employed having a common timebase between sensors 38 to know when they are allowed to "speak".

Although timing of voltage polarities between sensors 38 can be implemented via radio or by using GPS, communication in the track rails was recognized by the present inventors to advantageously reduce the cost of the communication system. The foregoing synchronization scheme discussed above thus provides a common timebase between sensors 38 to know when they should apply a particular voltage polarity as stated herein before.

Since there are no insulated joints in the section of rail track, any information that is transmitted or received may travel further than desired (if concerned about rail vehicle detection) or potentially not far enough (if concerned about cascading information between sensors about broken rails and/or vehicle detection). A need therefore exists for each sensor 38 to know to whom it is speaking with (transmitting or receiving). Sensor IDs can be incorporated in the message bits to achieve this task. Established communication timeslots can be employed during the communication phase such that the message structure provides the sensor ID bits to make sure that each sensor 38 knows who it is communicating with. The above synchronization and communications schemes are implemented in one embodiment that is described herein below with reference to FIGS. 11-14.

Moving now to FIG. 11, a flow diagram 500 illustrates a method of synchronizing, testing and communicating between the current sensors 38 depicted in FIG. 1 in accordance with an exemplary embodiment of the present invention. Importantly, this method implements a time division multiplexing scheme that is particularly useful to provide reliable communications between sensors that are positioned along a rail that is devoid of insulated joints between the sensors. During operation of the rail break or rail vehicle detection system 10, the sensors 38 are first initialized as represented by step 502. During this initialization step 502, each sensor 38 is assigned a unique identifier that represents its physical position relative to each of the remaining sensors 38. Each sensor 38 is also supplied with the total number (N) of system sensors 38 during the initialization step 502.

Following initialization 502, the system sensors 38 enter a synchronization phase 600. Block 510 illustrates sequential synchronization of the current sensors 38 in which, according to one embodiment, sensor number 1 includes a master clock that is used to synchronize operation of all the current sensors 38. While the master clock is running, it is also waiting in one embodiment for example, for a command signal sent by a dispatcher, or the presence of a train, or some other desired signal (e.g. RF signal, direct wired signal, etc.). Upon receipt of this master clock command signal, the master clock transmits a sync signal on the rail track 14, 16, allowing each sensor 38 to sequentially synchronize its respective timer with the master clock during a synch frame such as shown in block 510.

Upon completion of the synchronization phase 600, the system sensors 38 enter a test phase 700. During this test phase 700, each sensor operates sequentially as shown in block 512, with respect to the remaining sensors 38 in the system, such as described herein before with reference to FIGS. 1-10, to detect either a rail break or the presence of a rail vehicle such as a train within its respective detection zone.

When a sensor 38 detects the presence of a rail break or a rail vehicle within its zone, it then transmits this information out to the ends of the zone such as shown in block 514 during a communication phase 800, thus providing a safety signal to indicate such presence. Another rail vehicle outside the zone, upon receiving the sensor safety signal, may not enter the zone if such entry presents a safety hazard.

FIG. 12 is a detailed flow diagram of the synchronization phase 600 depicted in FIG. 11 in accordance with an exemplary embodiment of the present invention, in which block 510 depicts a high level synchronization of the sensors 38. Sensor number 1 having the master clock is first turned on at the onset of the synchronization phase as represented by step 602. Subsequent to the turn on of sensor number 1, all remaining sensors are in a listening state. Sensor number 1 transmits its particular synch identification (ID) and starts a countdown timer. This countdown timer includes a buffer period of sufficient length to allow all remaining sensors to complete their respective synchronization cycles. During this buffer period, each sensor interrogates itself to determine if it is sensor number 1, as represented in step 604. If the sensor is not sensor number 1 as represented by step 605, then it continues to listen for any upstream synch ID as represented in step 606. If a synch ID is not heard, the sensor will continue to listen for any upstream synch ID as represented by step 608. If a synch ID is heard as represented by step 610, the sensor will check to determine if the synch ID was received from an adjacent upstream sensor as represented by step 612. If the synch ID is received from an adjacent upstream sensor as represented by step 614, the sensor receiving the adjacent upstream sensor synch ID makes a determination as to whether it is the last sensor to be synchronized as represented by step 616. If the sensor is not the last sensor as represented by step 617, it then transmits its own synch ID as represented in step 618 and starts its own countdown timer including a buffer period of sufficient length to allow all remaining sensors to complete their respective synchronization cycles as represented in step 620. If the sensor is the last sensor to be synchronized as represented by step 621, its respective timer is allowed to continue its countdown to the test phase 700, as represented by step 623.

If the sensor is not sensor number 1 as represented by step 603, it then transmits its own synch ID as represented by step 607, and allows its countdown timer to continue its countdown cycle to the test phase 700, as represented by step 609.

If, during step 612, the sensor did not receive a synch ID from an adjacent upstream sensor, as represented by step 622, the sensor starts its own countdown timer including a buffer period of sufficient length to allow all remaining sensors to complete their respective synchronization cycles as represented in step 624, and then continues to listen for an adjacent upstream synch ID as represented in step 626. If an adjacent sensor synch ID is not heard, as represented in step 628 the sensor continues to listen for an adjacent sensor synch ID as represented in step 626. If an adjacent sensor synch ID is heard as represented by step 630, the sensor then makes a determination as to whether it is the last sensor to be synchronized as represented by step 632. If the sensor is the last sensor to be synchronized as represented by step 634, it updates its own internal countdown timer to the start of the test phase 700, as represented by step 636.

If the sensor is not the last sensor to be synchronized as represented by step 638, it then transmits its own synch ID as represented by step 640, and updates its countdown timer to the start of the test phase 700, as represented by step 642.

FIG. 13 is a detailed flow diagram of the test phase 700 depicted in FIG. 11 in accordance with an exemplary embodiment of the present invention in which block 512 depicts a high level sequential testing of the sensors 38. The test phase 700 begins in one embodiment by first applying a baseline positive voltage an measuring the current flowing through each current sensor 38 while all voltage sources generate the baseline positive voltage as represented by steps 702 and 704 and similar to process steps 102 and 104 discussed herein before with reference to FIG. 4. Next, as shown in steps 706-714, a positive test voltage and a negative test voltage are sequentially applied via each voltage source, while all other voltage sources apply zero volts, similar to the process steps 106 and 108 described herein before with reference to FIG. 4. Current measurements via the current sensors 38 are implemented sequentially for the test zone during a desired test frame cycle as represented in steps 710-714. Upon completion of this portion of the test cycle, the foregoing process is repeated for a baseline negative voltage as represented in steps 716-726. Upon completion of the test frame cycle associated with the baseline negative voltage as represented in step 728, current measurements resulting from the baseline positive and negative voltages are averaged together to produce an average baseline current for the sensors 38; while test currents resulting from the +/− test voltages are averaged together to produce an average test current, as represented in step 730. A differential current value based on a difference between the absolute values of the average baseline current and the average test current is then determined for each zone as represented in step 732. Each differential current value is compared with a desired threshold value as represented in step 734 to determine the presence of a rail break or a rail vehicle in the respective zone as represented in step 736. Although two signatures (baseline average voltage and +/− test voltage pattern) are depicted in the test phase 700, any different number of signature types can be employed to further refine and increase the reliability of the test measurements, as stated herein before.

Moving now to FIG. 14, a detailed flow diagram depicts a communication scheme (phase) 800 in accordance with an exemplary embodiment of the present invention, in which block 514 depicts high level synchronization of sensor 38 communication frames. During this communication phase 800, each current sensor 38 remains in a wait state pending a respective time slot during which it is allowed to communicate as represented in steps 802 and 804. During a respective time slot, the sensor then makes a determination as to whether it is the lowest sensor in the zone as represented in step 806. If the sensor is the lowest sensor in the zone, it then transmits its ID as represented in step 808. Subsequent to transmitting its ID, the sensor then make a determination as to whether it saw or heard about the presence of a broken rail or a rail vehicle as represented in steps 810-814. The sensor then transmits the ID of the sensor, including itself, that either saw or heard about the presence of a broken rail or a rail vehicle as represented in steps 816-822. Subsequently, the sensor continues to listen for and receive any adjacent sensor IDs and IDs that indicate the presence of either a rail break or a rail vehicle as represented in step 826.

If during step 804 of the communication phase 800, the sensor determines that it is not the lowest sensor in the zone, it enters a different portion of the communication phase as represented by steps 828-848 where it awaits reception of an adjacent upstream sensor ID including bits that communicate the presence or absence of a rail break or rail vehicle that it then transmits onto the communication rail bus.

If the entire communication phase is complete, as represented in step 850, then the presence or absence of a rail break or rail vehicle is transmitted to a desired destination via a desired communication protocol as represented in steps 852-854. If the entire communication phase is not yet complete, the process continues by looping back to step 802 where each sensor continues to await its timeslot at which time the entire process described herein above continues until it is complete as represented in step 850. Upon completion of the communication phase 800, the sensors can repeat the foregoing process or enter a sleep mode to once again await a command signal from a dispatcher, a trigger signal, etc.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A method for detecting a rail break or presence of a rail vehicle in a block of a rail track devoid of insulated joints, the method comprising:

applying a plurality of voltage patterns across a block of track having a plurality of zones via a plurality of voltage sources by sequentially applying a desired voltage via each voltage source while all remaining voltage sources apply zero volts;

determining a plurality of signatures based on the plurality of voltage patterns;

and comparing the plurality of signatures with a predetermined criteria to detect the presence of a rail break or rail vehicle in the block of rail track.

2. The method of claim 1, wherein applying a plurality of voltage patterns comprises applying a desired voltage simultaneously via the plurality of voltage sources.

3. The method of claim 1, wherein determining a plurality of signatures comprises measuring or determining a plurality of currents through a respective source resistance associated with each zone in response to application of the plurality of voltage patterns.

4. The method of claim 1, wherein comparing the plurality of signatures with a predetermined criteria to detect the presence of a rail break or rail vehicle in the block of rail track comprises comparing the plurality of signatures with a decision surface.

5. The method of claim 4, wherein the decision surface is indicative of whether currents flowing through the plurality of zones are more or less than a predetermined threshold limit.

6. The method of claim 1, wherein applying a plurality of voltage patterns across a block of track having a plurality of zones via a plurality of voltage sources comprises applying the plurality of voltage patterns using a plurality of voltage levels.

7. The method of claim 6, further comprising averaging the plurality of voltage levels to mitigate systematic and galvanic errors.

8. A system for detecting a rail break or presence of a rail vehicle in a block of a rail track devoid of insulated joints, the block of the rail track comprising a plurality of zones, the system comprising:

a plurality of voltage sources, each coupled to one of the plurality of zones; and a plurality of current sensors, each coupled to a respective voltage source and configured to sense current flowing through the current sensor in response to changing voltage patterns generated by the plurality of voltage sources, and further configured to generate a plurality of signatures based on the sensed current, wherein the changing voltage patterns are generated through the plurality of voltage sources by sequentially applying a desired voltage via each voltage source while all remaining voltage sources apply zero volts.

9. The system of claim 8, wherein the plurality of current sensors are further configured to compare the plurality of signatures to a predetermined criteria to detect the presence of a rail break or rail vehicle in the block of rail track.

10. The system of claim 9, wherein the predetermined criteria comprises a decision surface.

11. The system of claim 8, wherein each current sensor is further configured to average measured current values to mitigate systematic and galvanic errors.

12. The system of claim 8, wherein the predetermined criteria comprises a maximum or minimum threshold value.

13. The system of claim 8, wherein each voltage source is configured as a source resistance compensated voltage source comprising a four-wire system including a plurality of sense wires.

14. A method of in-rail communication in a block of rail track devoid of insulated joints, the method comprising:

transmitting and receiving via a rail track, communication frames in a synchronized format between a plurality of sensors that are responsive to voltage pattern changes along desired portions of the block of rail track; and monitoring the communication frames to determine the presence of a rail break or rail vehicle in the block of rail track, wherein the voltage patterns changes are generated through the plurality of voltage sources by sequentially applying a desired voltage via each voltage source while all remaining voltage sources apply zero volts.

15. The method of claim 14, wherein transmitting and receiving via a rail track, communication frames in a synchronized format comprises transmitting and receiving via a rail track, communication frames in a time division multiplexed access format.

16. The method of claim 15, wherein transmitting and receiving via a rail track, communication frames in a synchronized format, comprises transmitting and receiving via a rail track, sensor IDs having a message structure that identifies whether or not a particular sensor has sensed or heard about the presence of a rail break or rail vehicle within the block of rail track.

17. A method for communicating the presence of a rail break or a rail vehicle in a block of a rail track having a plurality of zones, the method comprising:

in a block of rail track devoid of insulated joints, synchronizing via a communication scheme, communication between a plurality of sensors disposed along the block of rail track;

applying a plurality of voltage patterns across the block of track having a plurality of zones via a plurality of voltage sources, wherein the plurality of voltage patterns are applied through the plurality of voltage sources by sequentially applying a desired voltage via each voltage source while all remaining voltage sources apply zero volts;

monitoring a change in the plurality of voltage patterns via the plurality of sensors to detect the presence of a rail break or rail vehicle in one or more zones of the block of rail track; and communicating in a time division multiplexed access (TDMA) format between the plurality of sensors, sensor IDs that indicate the presence or absence of a rail break or rail vehicle within one or more zones of the block of rail track.

18. The method of claim 17, wherein communicating in a TDMA format comprises communicating frames of DC coded bits that identify a particular sensor within the plurality of sensors.

19. The method of claim 18, wherein communicating in a TDMA format further comprises communicating frames of DC coded bits that identify whether a particular sensor has detected or heard about the presence or absence of a rail break or rail vehicle.

* * * * *